United States Patent [19]

Ishizuka

[11] Patent Number: 4,843,942

[45] Date of Patent: Jul. 4, 1989

[54] GUITAR PICK

[76] Inventor: Kachu Ishizuka, 29237 Whitley Collins Dr., Rancho Palos Verdes, Calif. 90274

[21] Appl. No.: 237,233

[22] Filed: Aug. 26, 1988

[51] Int. Cl.[4] ..... G10D 3/16
[52] U.S. Cl. ..... 84/322
[58] Field of Search ..... 84/322

[56] References Cited

U.S. PATENT DOCUMENTS 3,650,172 3/1972 Osborne ..... 84/322

*Primary Examiner*—Lawrence R. Franklin
*Attorney, Agent, or Firm*—Koda and Androlia

[57] ABSTRACT

An artificial guitar pick including a coupler for attaching an artificial nail to the end of a natural nail. The coupler has grooves into which the natural nail and the artificial nail are inserted. The artificial nail has a curvature that approximates that of natural nails. The guitar pick does not cause any unnatural feeling to the player.

3 Claims, 1 Drawing Sheet

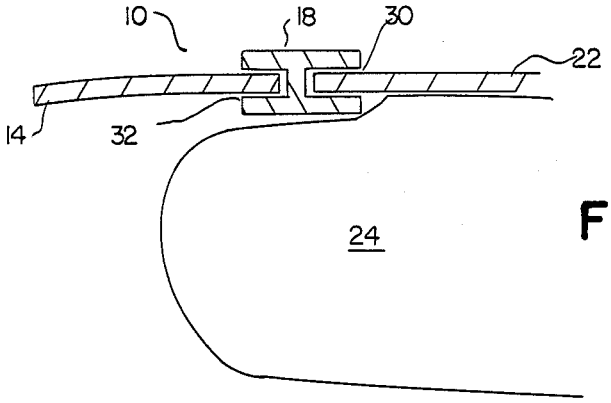
FIG. 1
FIG. 2
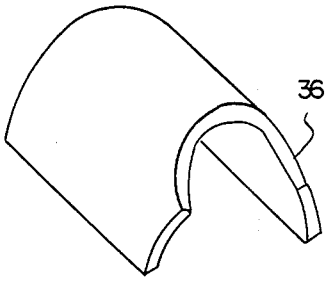
FIG. 3
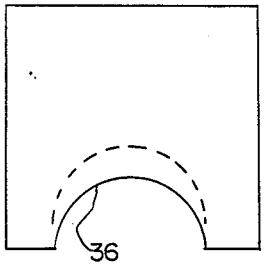
FIG. 4
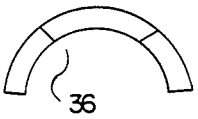
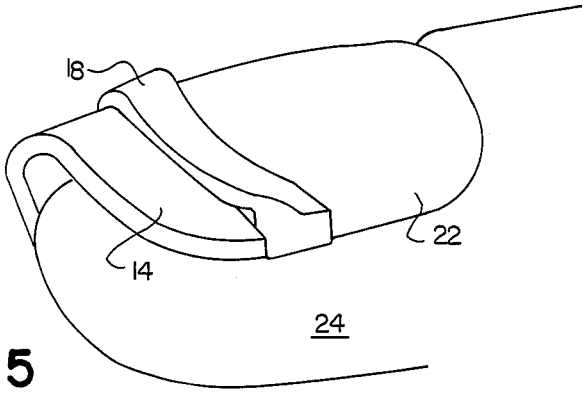
FIG. 5

GUITAR PICK

BACKGROUND OF THE INVENTION

1. Field of the Invention

This invention relates to a guitar pick, and more specifically a guitar pick which is fitted over a guitar player's fingernail.

2. Prior Art

To play the guitar, especially the classical guitar, the player usually grows long fingernails on the thumb and three fingers of the picking hand. Unlike some guitar playing, a single pick will not suffice. However, long nails have certain drawbacks. For instance, long nails have a tendency to break or crack. The nails of some people grow in a hook-like shape, thereby making it impossible to play the guitar at fast speeds when using the techniques of arpeggio or the effect of tremollo. Furthermore, long nails cause considerable trouble in daily life. Therefore, there has been a demand for artificial nails to be used as guitar picks for classical guitar.

Artificial nails must be able to attach to and detach from each finger with ease. The artificial nail must not apply unnatural stress to the finger or nail and must not feel unnatural when being worn. The artificial nail should fit closely to the natural nail and should have a somewhat semicylindrical shape to serve as a natural extension of the natural nail. A plastic artificial nail has the necessary softness, strength and flexibility to absorb the clicking noise generated when the artificial nail contacts the string. After worn or deformed through use, the artifical nail should be easily replaceable.

Previous artificial nails have included thimbles on the finger. As shown in U.S. Pat. No. 3,927,595, a thimble is useful for the hand used to depress the strings of the guitar. U.S. Pat. Nos. 401,476; 584,653; 842,920; 1,444,982; and 1,885,843 show different thimbles for the picking hand. Unfortunately, a thimble applies stress to the finger rather than the fingernail. As a result, the thimble is not suitable to play classical guitar that requires delicate motions with the fingers because the player does not have the necessary control.

Other methods include means of attaching an artificial nail to the upper or lower surface of the nail. U.S. Pat. No. 3,650,172 shows an artificial nail set over the upper surface of the natural nail. Unfortunately, because the artifical nail is offset from the extension line of the natural nail, the user perceives an unnatural feeling caused by the offset. If the material forming the artificial nail is metal, a clicking noise is generated. If the artificial nail is plastic, when the tip portion is worn the entire nail must be replaced, thereby requiring higher costs.

An artifical nail useful as a guitar pick has many requirements. Therefore, an ideal guitar pick that does not cause an unnatural feeling, is easily applied and removed, does not create a metallic clicking sound and gives the user the delicate control needed, has not been provided by previous artificial guitar picks.

SUMMARY OF THE INVENTION

According to the present invention, a guitar pick is provided that alleviates these and other problems of prior devices. The pick is lightweight, compact and can be designed to accommodate nail tips of different lengths. The pick does not give the user unnatural feeling and provides delicate control over the picking action.

According to the present invention, an artificial nail is provided that acts as an extension of the user's own fingernail. The artificial nail is attached to the natural nail along approximately the same plane as the natural nail. The artificial nail can be easily attached and removed without damaging the natural nail. The artificial nail is made of inexpensive materials and the only portion that wears out is easily and inexpensively replaceable.

According to the present invention, an artificial nail is attached to a coupler. The coupler is then attached to the end of the natural nail to create the effect of a long natural nail without the user actually growing long fingernails. The natural nail is thus not subjected to stress. The artificial nail does not cause the unpleasant clicking sound so often associated with artificial nails.

BRIEF DESCRIPTION OF THE DRAWINGS

The guitar pick of the present invention may be better understood by reference to the attached drawings in conjunction with the following detailed description, wherein:

FIG. 1 is a side view of a finger with the guitar pick attached to the fingernail;

FIG. 2 is a perspective view of the plastic pick of FIG. 1;

FIG. 3 is a top view of the plastic pick of FIG. 1;

FIG. 4 is an end view of the plastic pick of FIG. 1; and

FIG. 5 is a perspective view of the guitar pick attached to the fingernail.

DETAILED DESCRIPTION OF THE INVENTION

Referring now to FIG. 1, an artificial guitar pick 10 according to a preferred embodiment of the present invention is shown. The guitar pick 10 comprises an artifical nail 14 connected by a metal coupler 18 to a natural nail 22 and a fingertip 24. As a result, the artifical guitar pick 10 acts as an extension of the natural nail 22. This creates the feeling of a long nail without the disadvantages of long nails.

The coupler 18 is formed with a curvature approximating the normal curvature of human fingernails. More specifically, the coupler 18 is custom made to fit each individual using metallurgic technology similar to that used in dental processes. However, the artificial guitar pick 10 is flexible enough to be mass produced.

The coupler 18 is formed somewhat in the shape of a curved I-beam and thus has a fingernail groove 30 and an artificial nail groove 32. The groove 30 follows the entire curvature of the coupler 18 so that the natural nail 22 fits snugly into the groove 30. The artificial nail 14 tightly fits into the entire length of the groove 32. The natural nail 22 can be inserted into the nail groove 30 with litle force, but the groove 30 has a sufficient hold on the nail 22 to prevent the nail 22 from coming off when picking a guitar string or even when vigorously shaking the hand. The artificial nail 14 may be pressed into the groove 32 by hand to achieve a tight fit.

The metal coupler 18 is preferably cast using the lost wax process as is widely used in dental laboratories. The dimensions of the coupler 18 may be precisely controlled by properly performing the expansion control of the mold during the lost wax casting process. The lower wall of groove 30 is preferably made as thin (about 0.2 mm) as possible so as not to cause an unnatural feeling when inserted between the nail and the finger.

As shown in FIGS. 2 and 4, the artificial nail 14 has a semicylindrical shape with a curvature approximating that of natural nails. A portion 36 of the artificial nail 14 is formed in such a shape as to closely fit the top of a natural fingernail. The artificial nail 14 is preferably made of a flexible, relatively soft plastic.

As indicated by dashed lines in FIG. 3, the artificial nail 14 is preferably manufactured with a substantial amount of extra plastic so that the nail 14 can be cut to a desired shape according to the proposed use of the pick. After the artificial nail 14 is inserted into the groove 32 of the coupler 18, the superfluous portion is cut off with nail clippers. The nail can then be filed, trimmed and polished into the desired shape. In this way the nail 14 can be adapted to many different shapes to adjust for the preferences of different users and different uses.

The present invention has numerous advantages over prior guitar picks. The guitar pick 10 of the present invention attaches to the user's fingernail and does not apply unnatural stress to the finger or nail. The guitar pick 10 fits closely to the natural nail and has a semicylindrical shape to serve as a natural extension of the natural nail. The guitar pick 10 is easily attached to the natural nail and even delicate picking may be accomplished without loss of feeling as was often the case with prior devices. The guitar pick 10 thereby creates the sensation of having long fingernails without the drawbacks of having long nails.

When the artificial nail 14 of the pick 10 wears out, only the nail portion needs to be replaced. The artificial nail 14 may be made of plastic having the strength, flexibility and softness needed to absorb the clicking noise generated when the artificial nail contacts the string. The coupler 18 is made of metal and therefore is very durable.

These and other advantages will all be apparent to those of skill in the art. Of course, the above disclosure is merely representative and is not meant to limit the invention in any way.

I claim:

1. A guitar pick comprising:

an artificial nail having a predetermined curvature substantially similar to the curvature of a human fingernail and a recess substantially similar to a tip of the fingernail; and a coupler having a first groove and a second groove extending along the curvature of the coupler on opposing sides of the coupler, said first groove having predetermined dimensions to allow insertion of the artificial nail into the first groove so that the artificial nail is tightly held inside the groove and said second groove having dimensions to allow insertion of the fingernail into the second groove so that the fingernail is snugly held inside the second groove.

2. The guitar pick of claim 1 wherein the artificial nail is made of plastic.

3. The guitar pick of claim 1 wherein the coupler is made of metal.

* * * * *